US009016668B1

(12) United States Patent
Christensen et al.

(10) Patent No.: US 9,016,668 B1
(45) Date of Patent: Apr. 28, 2015

(54) STACKABLE BARRIER WITH CONNECTOR

(75) Inventors: Marc E. Christensen, Salt Lake City, UT (US); David J. Lipniarski, North Tonawanda, NY (US); Joseph C. Mecham, Salt Lake City, UT (US)

(73) Assignee: Off the Wall Products LLC, Salt Lake City, UT (US)

( * ) Notice: Subject to any disclaimer, the term of this patent is extended or adjusted under 35 U.S.C. 154(b) by 0 days.

(21) Appl. No.: 13/193,364

(22) Filed: Jul. 28, 2011
(Under 37 CFR 1.47)

Related U.S. Application Data

(60) Provisional application No. 61/369,606, filed on Jul. 30, 2010.

(51) Int. Cl.
*E01F 15/00* (2006.01)
*E04H 17/16* (2006.01)

(52) U.S. Cl.
CPC ..... *E04H 17/16* (2013.01)

(58) Field of Classification Search
USPC ..... 256/19, 27, 1, 13.1; 52/604, 586.1, 52/586.2, 779; 404/6, 9; 405/286, 284, 405/114
See application file for complete search history.

(56) References Cited

U.S. PATENT DOCUMENTS 1,567,085 A * 12/1925 Rowland ..... 52/605
2,392,551 A * 1/1946 Roe ..... 52/586.2
3,640,039 A * 2/1972 McKee et al. ..... 52/281
4,040,759 A 8/1977 Skalle
4,143,857 A 3/1979 Weiner
4,498,660 A 2/1985 Brema et al.
4,597,236 A * 7/1986 Braxton ..... 52/564
4,614,181 A 9/1986 Karlsson
4,681,302 A 7/1987 Thompson
4,854,767 A 8/1989 Sasaki
4,869,018 A 9/1989 Scales et al.
5,011,325 A 4/1991 Antoniol
5,022,781 A 6/1991 Smith
5,080,523 A 1/1992 Steiner
5,123,773 A 6/1992 Yodock
5,197,601 A 3/1993 Sterett
5,259,154 A 11/1993 Lilley
5,387,049 A 2/1995 Duckett
5,452,963 A 9/1995 Christensen
5,493,816 A * 2/1996 Willemsen ..... 52/2.11
5,498,101 A 3/1996 Braverman
5,611,641 A 3/1997 Christensen
5,639,179 A 6/1997 Jensen
D385,362 S * 10/1997 Rossetti ..... D25/58
D400,264 S 10/1998 Striefel et al.
5,836,714 A 11/1998 Christensen
5,882,140 A 3/1999 Yodock, Jr. et al.
5,901,526 A 5/1999 Vidmar et al.
5,988,934 A 11/1999 Wasserstrom
6,059,487 A 5/2000 Haga et al.

(Continued)

*Primary Examiner* — Michael P Ferguson
(74) *Attorney, Agent, or Firm* — Workman Nydegger

(57) ABSTRACT

A barrier includes a housing having an exterior surface and an interior surface, the exterior surface having a front face and an opposing back face each extending between a top face and an opposing bottom face and also between a first side face and an opposing second side face, the interior surface bounding a chamber that is adapted to receive a ballast. An elongated first locking groove is recessed on the front face and extends between the top face and the opposing bottom face, the first locking groove including an elongated channel extending between the top face and the bottom face and a constricted mouth through which the channel can be accessed.

17 Claims, 16 Drawing Sheets

(56) References Cited

U.S. PATENT DOCUMENTS

| | | | | |
|---|---|---|---|---|
| 6,086,285 | A | 7/2000 | Christensen | |
| 6,189,282 | B1 * | 2/2001 | VanderWerf | 52/582.1 |
| D462,126 | S | 8/2002 | Englund | |
| 6,506,091 | B1 * | 1/2003 | Garpow | 446/75 |
| 7,144,188 | B1 * | 12/2006 | Mallinson et al. | 404/6 |
| 8,201,370 | B1 * | 6/2012 | Goodwin | 52/285.2 |
| 2002/0025221 | A1 | 2/2002 | Johnson | |
| 2003/0219308 | A1 | 11/2003 | Boulais et al. | |
| 2004/0057790 | A1 | 3/2004 | Tagg | |
| 2007/0098490 | A1 * | 5/2007 | Christensen | 404/6 |

* cited by examiner

STACKABLE BARRIER WITH CONNECTOR

CROSS-REFERENCE TO RELATED APPLICATIONS

This application claims priority to U.S. Provisional Application Ser. No. 61/369,606, filed Jul. 30, 2010, which for purposes of disclosure is incorporated herein by specific reference.

BACKGROUND OF THE INVENTION

1. The Field of the Invention

The present invention relates to barriers that can be stacked in a stable fashion and filled with a ballast.

2. The Relevant Technology

Control barriers are used in a variety of situations. For example, control barriers can be selectively positioned at special events or construction sites to help direct pedestrian and automobile traffic in a desired direction. Similarly, control barriers can be used at airports to delineate construction zones and direct ground traffic and taxiing aircraft in a desired direction. Alternatively, control barriers can be put up to help limit access to select areas. In yet other embodiments, control barriers can be put up to define an entertainment stage or the boundaries of a playing field. For example, control barriers can be used to define the boundaries of a soccer field or an ice skating rink.

Many current control barriers comprise hollow, elongated bodies that have tapered sides and are comprised of plastic. These control barriers can be placed at a desired location and then filled with water to prevent unwanted movement. Although such barriers are useful, they have limitations. For example, such barriers typically have a height in the range of 3-4 feet. The barriers are not designed to be stacked and, due to their configuration and design, cannot be stacked in a stable and secure configuration that would enable filling the barriers with water. As such, conventional control barriers are typically not helpful when an elevated wall type barrier is needed.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

As used in the specification and appended claims, directional terms, such as "up," "down," "left," "right," "upward," and "downward" are used herein solely to indicate relative directions in viewing the drawings and are not intended to limit the scope of the claims in any way.

Figure 1:
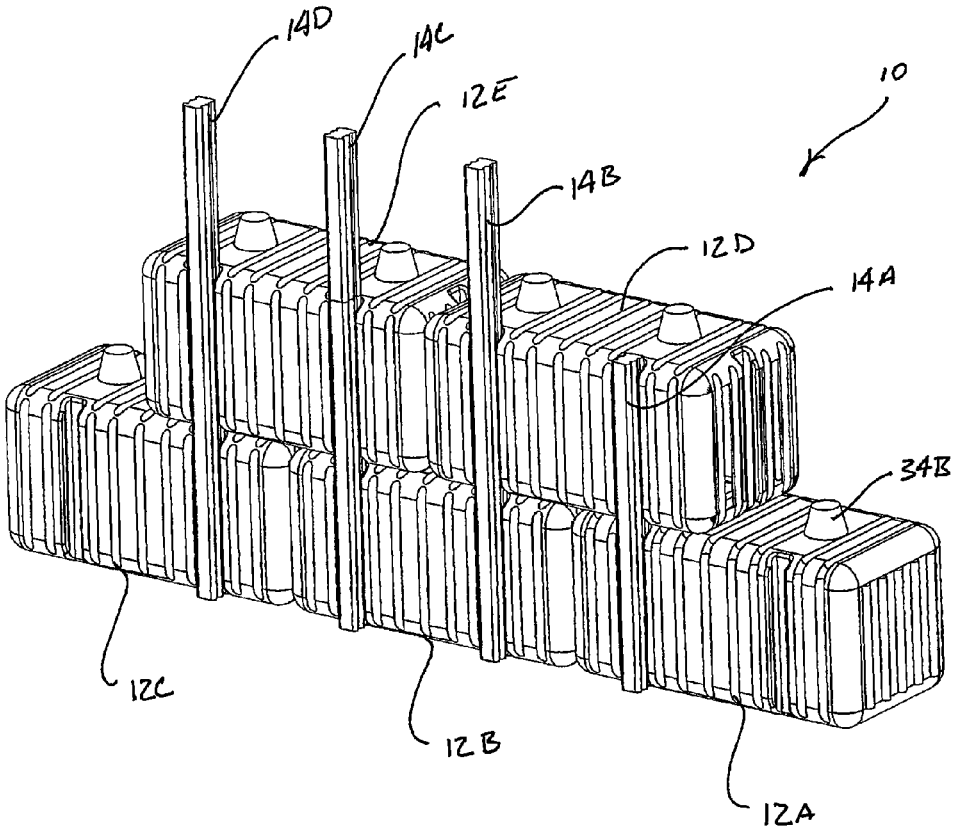
FIG. 1 is a perspective view of a barrier system wherein discrete barriers are stacked and secured together.

Depicted in FIG. 1 is one embodiment of an inventive barrier system 10 incorporating features of the present invention. As shown in FIG. 1, barrier system 10 comprises a plurality of barriers 12A-12G wherein select barriers 12 are coupled together by locking shafts 14A-14D. As will be discussed below in greater detail, it is appreciated that barrier system 10 can comprise any number of barriers 12 that can be placed in a variety of different configurations and wherein select barriers 12 can be coupled together by using one or more of locking shafts 14 at a variety of different locations.

Figure 2:
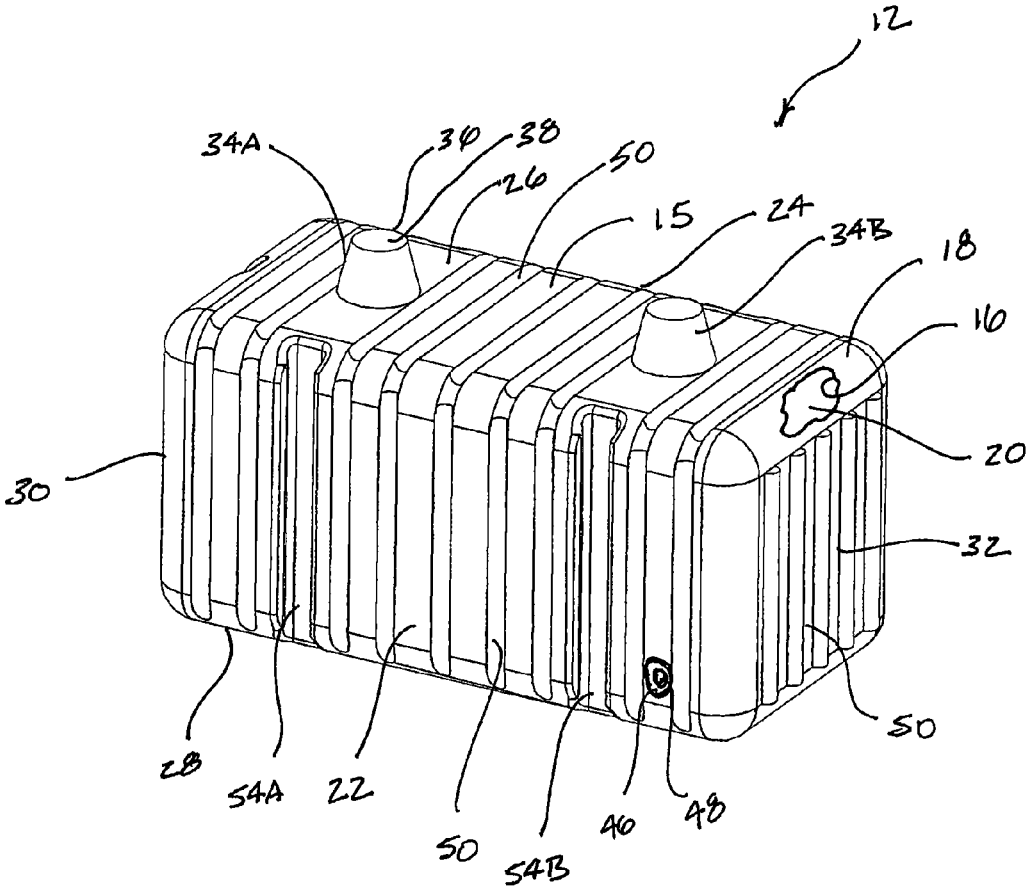
FIG. 2 is a front perspective view of one of the barriers shown in FIG. 1.

Turning to FIG. 2, barrier 12, which can correspond to any of barriers 12A-12G, comprises a housing 15 having an interior surface 16 and an opposing exterior surface 18, interior surface 16 bounds a chamber 20 that is adapted to receive a ballast. As used in the specification and appended claims, the term "ballast" is broadly intended to include any materials which can be poured into internal chamber 20. By way of example and not by limitation, the ballast can include water, salt water, non-freezing fluids, sand, rock, cement, Exterior surface 18 of housing 15 comprises a front face 22, and an opposing back face 24 which extend between a top face 26 and an opposing bottom face 28 and also between a first side face 30 and an opposing second side face 32. The above faces of housing 15 can form a parallel piped configuration which, if desired, can have rounded corners and/or rounded edges. The parallel piped configuration can have an elongated rectangular configuration or a cube configuration.

In one embodiment, housing 15 can have a height extending between top face 26 and bottom face 28 in a range between about 16 inches to about 32 inches with about 20 inches to about 28 inches being more common. Housing 15 can have a width extending between front face 22 and back face 24 in a range between about 16 inches to about 32 inches with about 20 inches to about 28 inches being more common. Housing 15 can also have a length extending between opposing side faces 30 and 32 which can be in the same range as the width or height or can be twice the range of the width or height. Other dimensions can also be used.

Barrier 12 further comprises a pair spaced apart projections 34A and 34B upwardly projecting from top surface 26 of housing 15. Projections 34 are typically disposed along a central longitudinal axis extending between side faces 30 and 32 and are typically disposed at equal distances from side faces 30 and 32. However, other locations can also be used. In the embodiment depicted, each projection 34 has a frusto-conical configuration. Each projection 34 terminates at an annular mouth 36 which bounds an opening 38. Opening 38 extends down through projection 34 so as to communicate with chamber 20. Openings 38 form an inlet port through which ballast can be fed into chamber 20. In alternative embodiments, it is appreciated that projections 34 need not have a frustoconical configuration but can have a transverse cross-sectional configuration having a variety of polygonal configurations or other configurations. However, symmetrical configurations are typically preferred. Furthermore, projections 34 can inwardly taper along the height, can extend vertically, or can have a combination.

Figure 3:
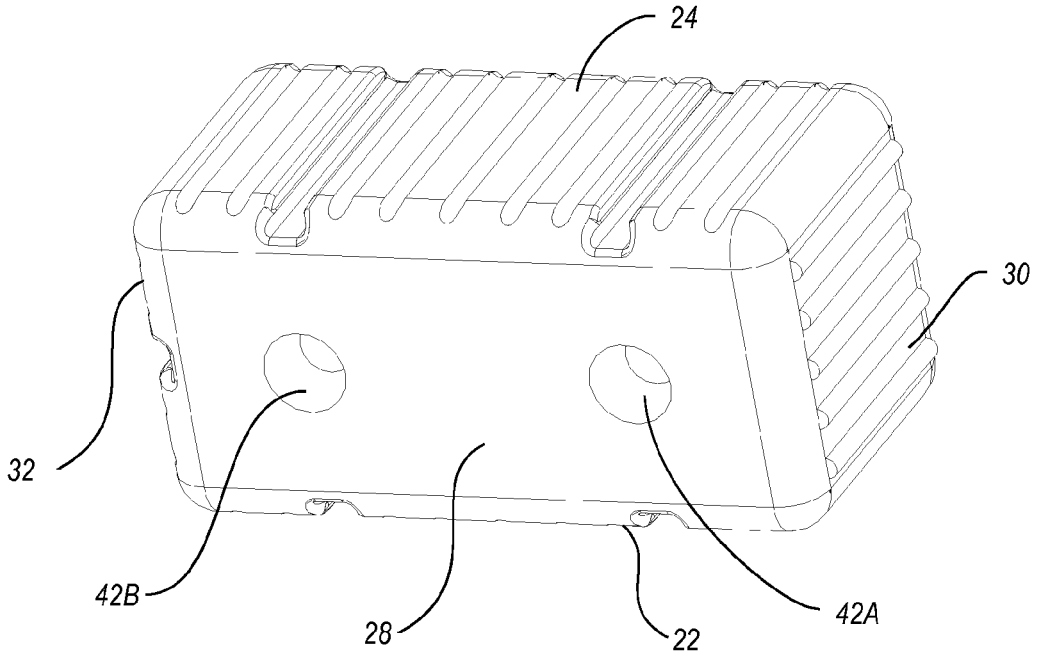
FIG. 3 is a bottom perspective view of the barrier shown in FIG. 2.

Turning to FIG. 3, a pair of spaced apart recesses 42A and 42B is formed on bottom surface 28. Recesses 42A and B are vertically aligned with projections 34A and B, respectively, and typically have a configuration complementary to projections 34A and B. Otherwise, recesses 42A and B are at least configured to receive projections 34A and B. Accordingly, as depicted in FIG. 1, barriers 12 can be placed on top of each other so that the projections 34 of the lower barrier 12A-C are received within the recesses 42 of the upper barriers 12D and E. The tapering of projections 34 and recesses 42 helps to facilitate proper and easy alignment and seating of the barriers. Furthermore receiving of projections 34 within recesses 42 facilitates a locking engagement between barriers 12 so that the upper barriers 12E and D are less likely to laterally slide off of lower barriers 12A-C.

Returning to FIG. 3, a drain hole 46 can be formed on housing 15 so as to communicate with chamber 20 and can be selectively plugged by a drain cap 48. Drain hole 46 is typically formed on front face 22 or back face 24 adjacent to bottom face 28 but can also be disposed on side faces 30 or 32 or at other locations.

In one embodiment, a plurality of spaced apart reinforcing grooves 50 can be recessed on the various faces of housing 15. Reinforcing grooves 50 provide greater structural integrity to the faces and help prevent bowing, bending, or other deformation of housing 15 when the barriers are loaded with a ballast into chamber 20 and/or when external loads are applied to the barriers, i.e., such as when multiple barriers are stacked on top of each other. In the depicted embodiment, reinforcing grooves 50 are shown extending vertically between top face 26 and bottom face 28 on faces 22, 24, 30, and 32. Corresponding reinforcing grooves 50 also are shown extending laterally between front face 22 and back face 24 along top face 26 and bottom face 28. In alternative embodiments, reinforcing grooves 50 can be oriented in a variety of different angles, need not be linear but can be curved, and can be replaced by spaced apart pockets that that are formed on the different faces. In yet other embodiments, reinforcing grooves 50 can be eliminated.

Figure 4:
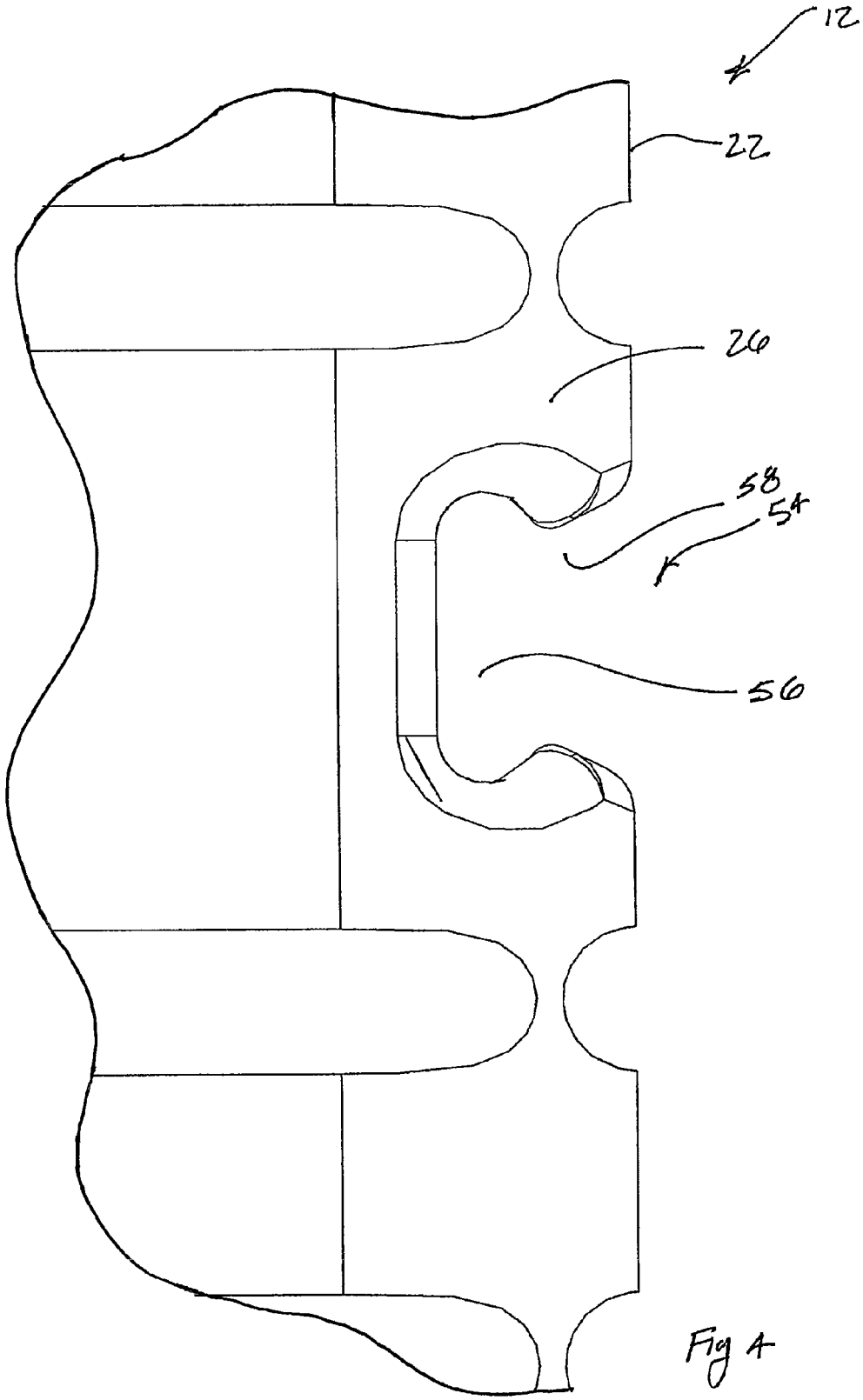
FIG. 4 is a top plan view of the locking groove of the barrier shown in FIG. 2.

Continuing with FIG. 2, housing 15 further comprises a plurality of locking grooves 54 formed thereon. For example, a pair of spaced apart locking grooves 54A and 54B are formed on front face 22 and extend between top face 26 and opposing bottom face 28. As depicted in FIG. 4, each locking groove 54 comprises an elongated channel 56 extending between top face 26 and opposing bottom face 28 and the constricted mouth 58 through which channel 56 can be accessed. It is appreciated that channel 56 can have a transverse cross-sectional configuration of any desired configuration. Mouth 58, however, needs to be constricted relative to a portion of channel 56 so that when a locking shaft 14 having a configuration complementary to locking groove 54 is received within and slid down the length of locking groove 54, locking shaft 14 can slide longitudinally along channel 56 but cannot be laterally pulled out through mouth 58.

Figure 5:
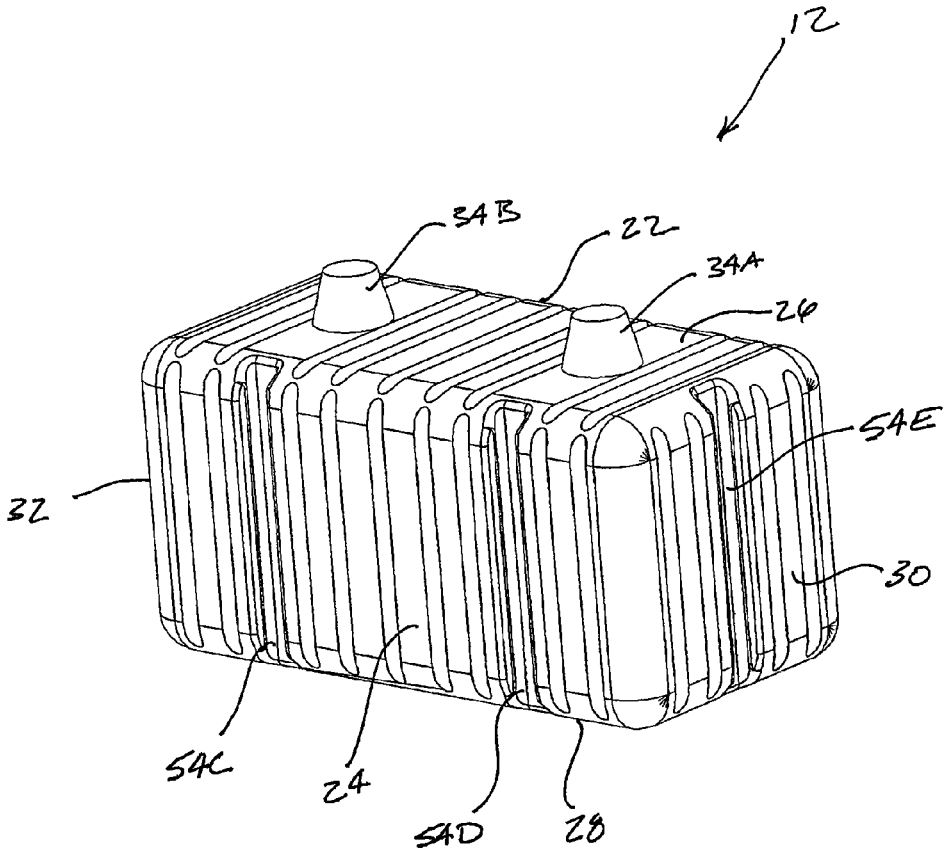
FIG. 5 is a back perspective view the barrier shown in FIG. 2.

As depicted in FIG. 5, a pair of locking grooves 54C and D are formed on back face 24 and extend between top face 26 and opposing bottom face 28. Likewise, locking groove 54E is centrally formed on side faces 30 and likewise extends between top face 26 and bottom face 28. Although second side face 32 is shown without a locking groove formed thereon, a locking groove can be centrally formed on side face 32 so that side faces 30 and 32 can have identical configurations.

Each of the locking grooves 54 typically have the same transverse cross-sectional configuration so that a single locking shaft 14 can be received within any of the locking grooves 54. In alternative embodiments, it is appreciated that one, two, three or more locking grooves 54 can be positioned on any of faces 22, 24, 30, or 32. Furthermore, it is appreciated that the various locking grooves 54 need not extend the full height of the corresponding faces but can extend only a portion of the height of the faces.

Figure 6:
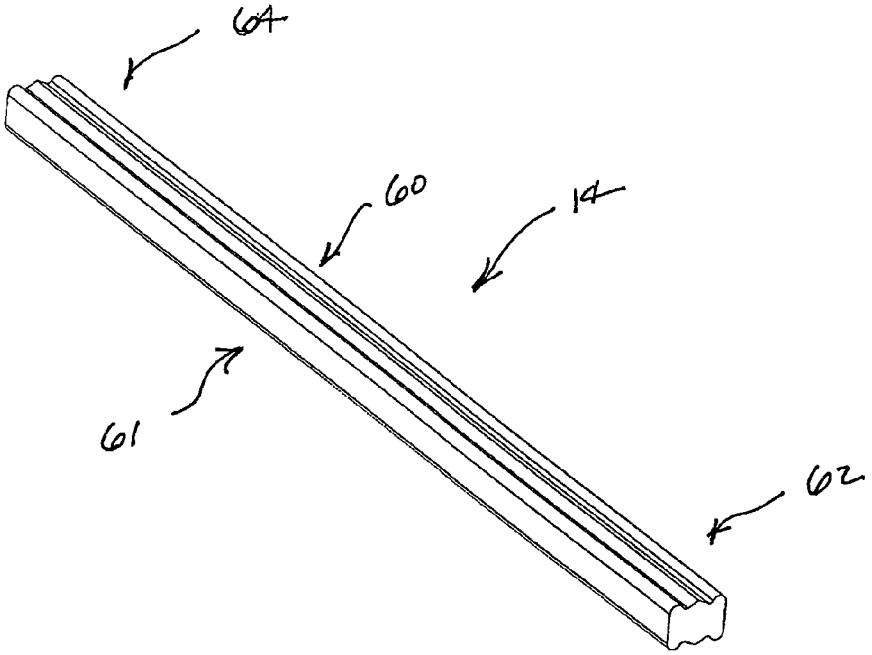
FIG. 6 is a perspective view of the locking shaft used in the barrier system shown in FIG. 1.
Figure 7:
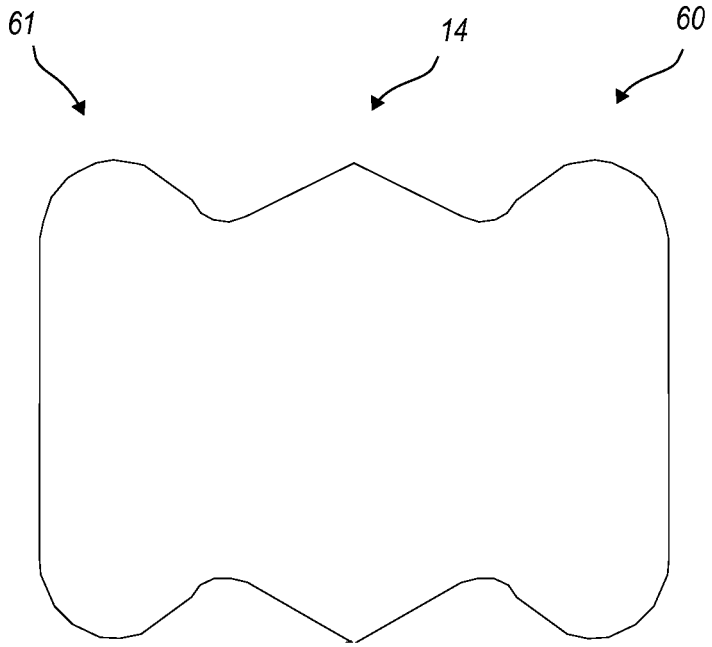
FIG. 7 is a plan view of the end of the locking shaft shown in FIG. 6.
Figure 8:
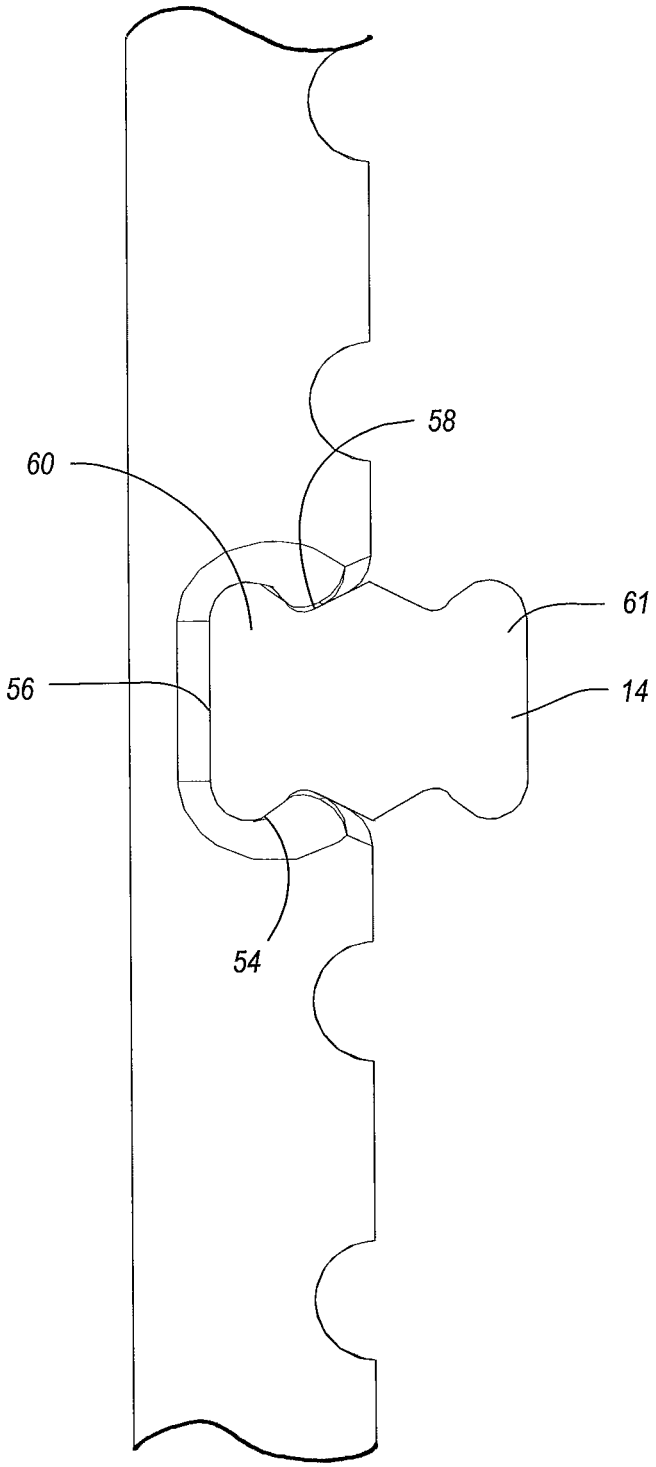
FIG. 8 is a top plan view of the locking shaft received within the locking groove.
Figure 9:
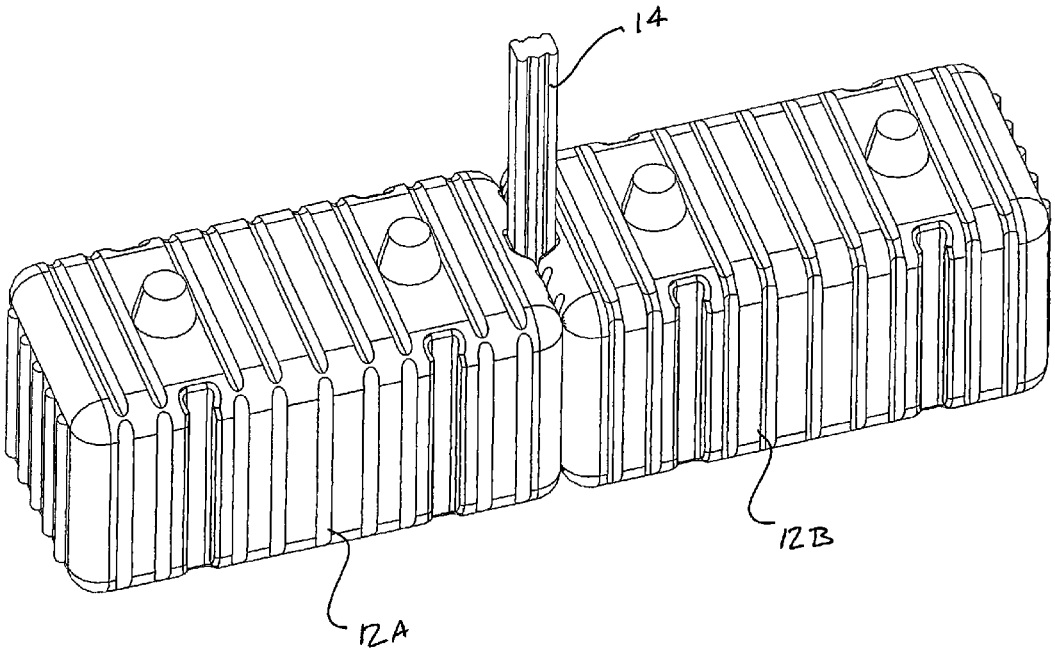
FIG. 9 is a perspective view of two barriers coupled together by the locking shaft.

As depicted in FIG. 6, each locking shaft 14 is elongated and has a first side 60 and an opposing second side 61 that each extend from a first end 62 to an opposing second end 64. It is appreciated that locking shafts 14 can have a variety of different configurations. However, as depicted in FIG. 8, at least one of sides 60 and 61, as discussed above, is configured so that locking shaft 14, or a portion thereof, can slide down into a corresponding locking groove 54 but is precluded from laterally passing out through mouth 58. For example, side 60 is shown received within locking groove 54. Side 60 is shown being complementary to locking groove 54 but need not be so as long as it can lock within locking groove 54. In the depicted embodiment, second side 61 is shown as being the same configuration as first side 60. This enable sides 60 and 61 to be received within locking grooves 54 of adjacent side-by-side barriers so as to lock the barriers together as shown in FIG. 9. In other embodiments, however, only one side of locking shaft can be configured to be received within a locking groove 54.

It is appreciated that the barrier system 10 can have a variety of different uses. For example, barriers 12 can commonly be used in forming walls where the barriers are stacked in heights of two, three, or more barriers. Such walls can be used as temporary retaining walls, as traffic walls, as barriers, or in any context where a barrier wall is needed. Such walls can also have military applications such as where the walls function as blast walls to guard against projectiles or explosives. In this embodiment, sand or rock is typically used as the ballast. In one conventional use, as depicted in FIG. 1, the barriers 12 are disposed longitudinally end to end to form a first row of barriers. A second row of barriers 12 is then placed end to end on top of the first row of barriers 12 with the second row being staggered relative to the first row. In this embodiment, projections 34 of adjacent barriers on the first row are received within the pair of recesses 42 of a single barrier on the second row. In this staggered orientation, locking grooves 54 of the first row of barriers and the second row barriers are vertically aligned along front face 22 and back face 24. As such, a locking shaft 14 can be slid down through aligned locking grooves 54. In this configuration, the locking shafts 14 help prevent the upper barriers from falling off the lower barriers.

In the embodiment depicted, locking shafts 14 are shown extending the full height of both the lower barriers and the upper barriers. In alternative embodiments, it is appreciated that locking shafts 14 can have a variety of different lengths. For example, in one embodiment a locking shaft can be a length that extends only half the height of the upper barriers such as when a third row of barriers are placed on top of the second row of barriers, a further locking shaft 14 can be passed down between the third row and second row of barriers. As also depicted, a single locking shaft can be of a length to extend along the height of three or more vertically stacked barriers. It is appreciated that the locking shafts 14 can be disposed along the front faces 22 or back faces of the stacked barriers and/or between the adjacent side faces.

Figure 10:
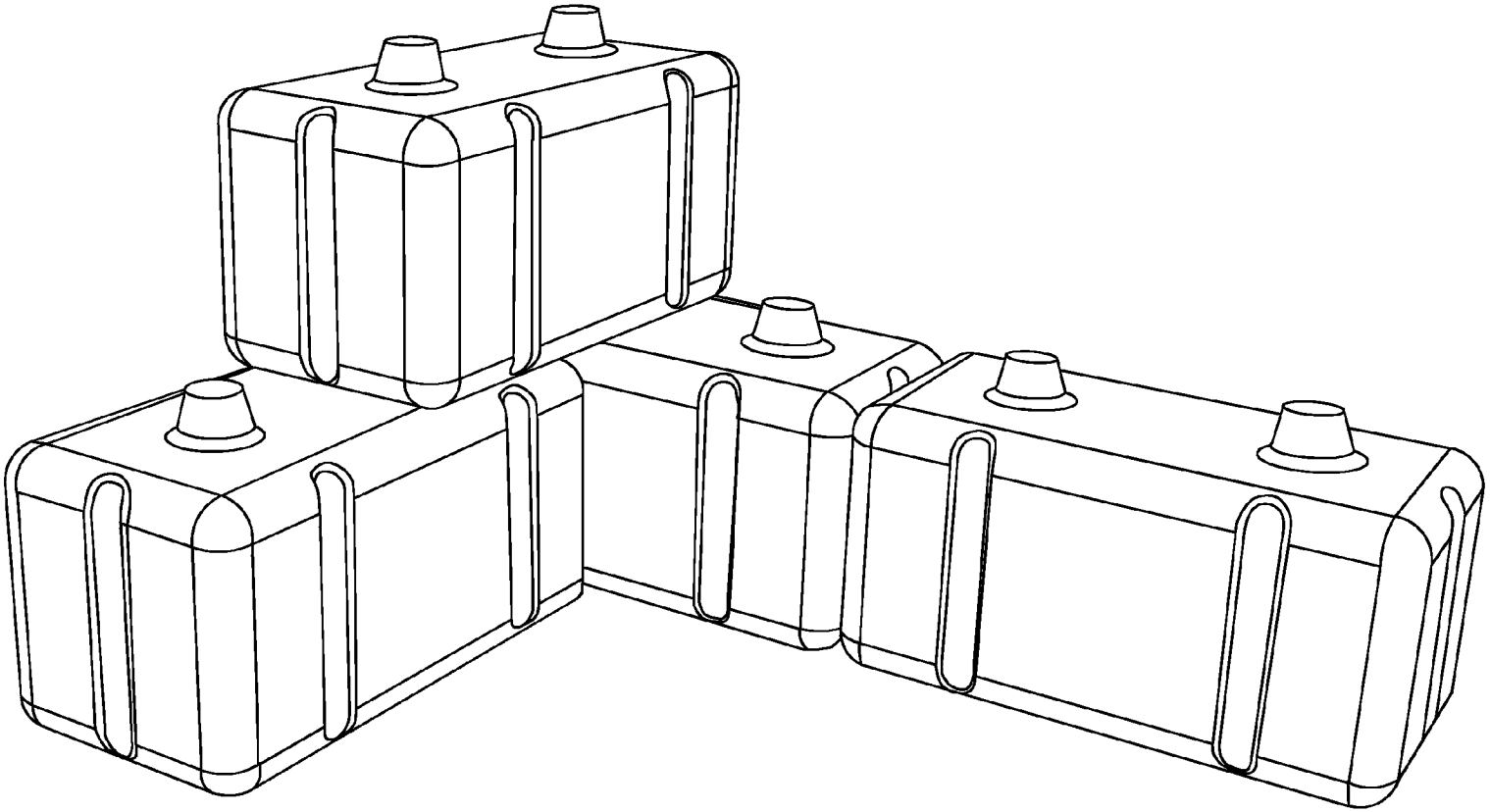
FIG. 10 is a perspective view of multiple barriers coupled together in the form of a corner.
Figure 11:
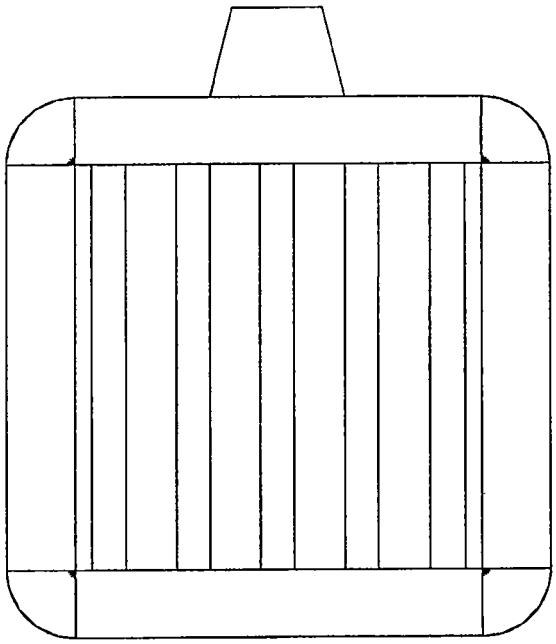
FIG. 11 is a right side elevational view of the barrier shown in FIG. 2.
Figure 12:
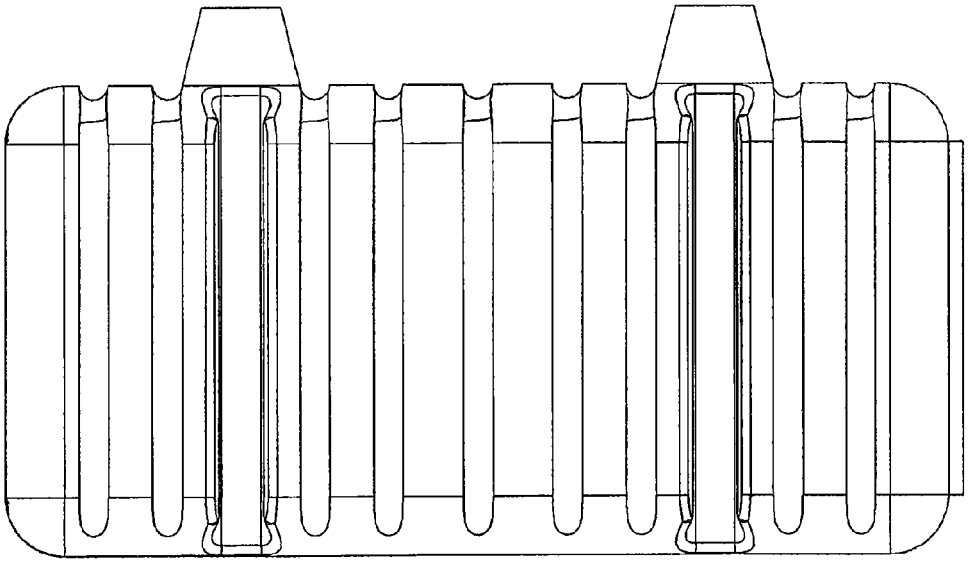
FIG. 12 is a back side elevational view of the barrier shown in FIG. 2.
Figure 13:
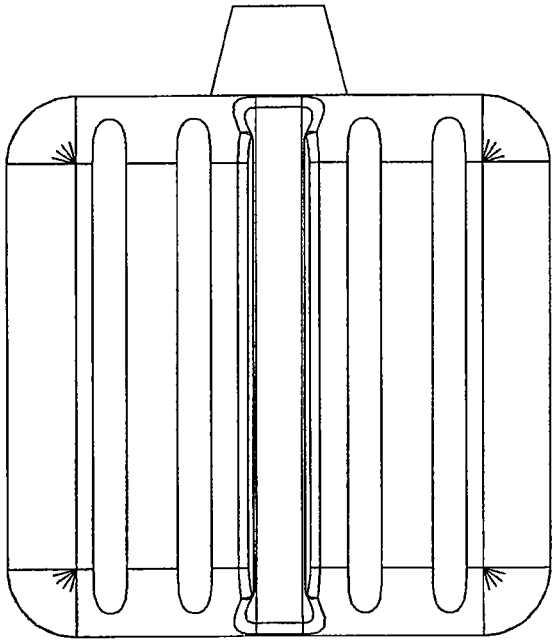
FIG. 13 is a left side elevational view of the barrier shown in FIG. 2.
Figure 14:
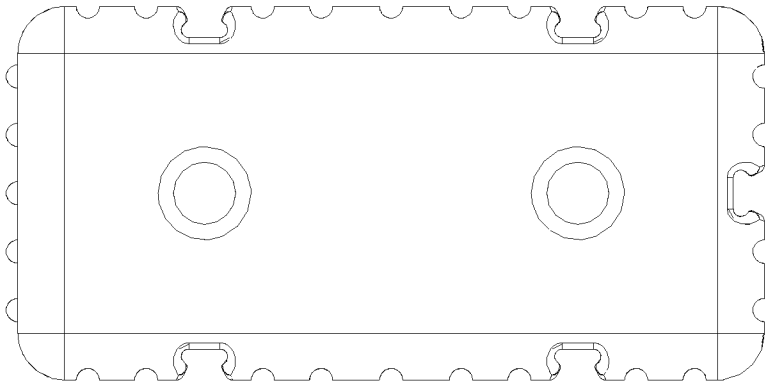
FIG. 14 is a bottom plan view thereof.
Figure 15:
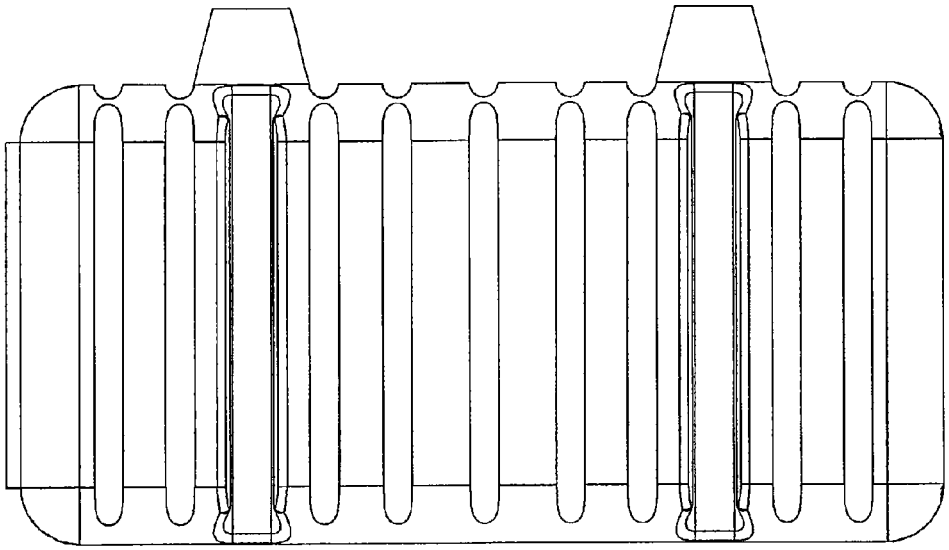
FIG. 15 is a front side elevational view thereof.
Figure 16:
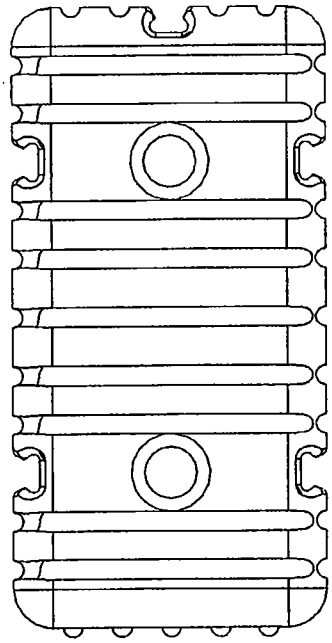
FIG. 16 is a top plan view thereof.

As shown in FIG. 10, barriers 12 can also be disposed orthogonal to each other to form corners. In this configuration, the locking grooves 54 on the end face of a barrier 12 can align with a locking groove 54 on a front or back face of an adjacent barrier 12. In view of the foregoing, it is appreciated that the various barriers can be placed in a variety of different configurations and that the locking grooves formed on the different faces of the barriers can be aligned with different locking grooves on different barriers such that locking shafts 14 can be passed therethrough to facilitate locking of the barriers together.

Barriers 12 disclosed herein are typically comprised of plastic and are typically formed by blow molding, rotational molding, or other conventional molding techniques.

FIGS. 11-16 shown different view of barrier 12.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A barrier comprising:

a housing having an exterior surface and an interior surface, the exterior surface comprising a front face and an opposing back face each extending between a top face and an opposing bottom face and also between a first side face and an opposing second side face, the interior surface bounding a chamber that is adapted to receive a ballast, the chamber being bounded by the front face, the opposing back face, the top face, the opposing bottom face, the first side face and the opposing second side face; and an elongated first locking groove recessed on the front face and extending between the top face and the opposing bottom face, the first locking groove including an elongated channel extending between the top face and the bottom face and a constricted mouth through which the channel can be accessed;

an elongated further locking groove recessed on the first side face and extending between the top face and the opposing bottom face, the further locking groove including an elongated channel extending between the top face and the bottom face and a constricted mouth through which the channel can be accessed; and a first projection outwardly extending from the top face of the housing, the first projection bounding a port extending therethrough that communicates with the chamber.

2. The barrier as recited in claim 1, further comprising an elongated further locking groove recessed on the front face and extending between the top face and the opposing bottom face, the further locking groove including an elongated channel extending between the top face and the bottom face and a constricted mouth through which the channel can be accessed, the further locking groove being spaced apart from the first locking groove.

3. The barrier as recited in claim 1, further comprising an elongated further locking groove recessed on the back face and extending between the top face and the opposing bottom face, the further locking groove including an elongated channel extending between the top face and the bottom face and a constricted mouth through which the channel can be accessed.

4. The barrier as recited in claim 1, further comprising a plurality of spaced apart reinforcing grooves formed on the front face and the back face of the housing, the front face including a plurality of flat faces that are disposed between the reinforcing grooves, the plurality of flat faces being disposed in a common plane.

5. The barrier as recited in claim 1, further comprising a first recess formed on the bottom face and projecting into the chamber, the first recess having a configuration complementary to the first projection.

6. The barrier as recited in claim 1, wherein the housing has a substantially parallelpiped configuration.

7. A barrier system comprising:

a first barrier as recited in claim 1; and an elongated first locking shaft extending between a first end and an opposing second end, a first end of the first locking shaft being slidably received within the first locking groove.

8. The barrier system as recited in claim 7, wherein the first locking shaft has a cross sectional configured with at least a portion thereof being tapered so that the locking shaft cannot pass out through the mouth of the first locking groove.

9. The barrier system as recited in claim 7, further comprising a second barrier disposed on the top face of the first barrier and having the same configuration as the first barrier, the second end of the first locking shaft being slidably received within the first locking groove of the second barrier.

10. The barrier as recited in claim 1, wherein the front face comprises a planar face that extends from the top face to the opposing bottom face.

11. The barrier as recited in claim 1, wherein the front face and opposing back face are rigid.

12. The barrier as recited in claim 1, further comprising a drain port formed on one of the front face, back face or opposing side faces and communicating with the chamber.

13. The barrier as recited in claim 1, wherein:

the front face of the housing has a first height extending between the top face and the bottom face that is measured at a central location between the first side face and the second side face; and the first side face has a second height extending between the top face and the bottom face, the second height being the same length as the first height.

14. The barrier as recited in claim 1, wherein the first locking groove on the front face and the further locking groove on the first side face both have the same length extending between the top face and the bottom face.

15. A barrier system comprising:

a first barrier comprising:

an elongated first housing having an exterior surface and an interior surface, the exterior surface comprising a front face and an opposing back face each extending between a top face and an opposing bottom face and also between a first side face and an opposing second side face, the first housing having a long axis extending between the first side face and the second side face, the interior surface bounding a chamber that is adapted to receive a ballast, the chamber being bounded by the front face, the opposing back face, the top face, the opposing bottom face, the first side face and the opposing second side face;

a first projection outwardly extending from the top face of the first housing, the first projection bounding a port extending therethrough that communicates with the chamber;

a first recess formed on the bottom face and projecting into the chamber; and an elongated first locking groove recessed on the first side face and orientated so as to at least partially extend between the top face and the opposing bottom face, the first locking groove including an elongated channel and a constricted mouth through which the channel can be accessed;

a second barrier comprising:

an elongated second housing having an exterior surface and an interior surface, the exterior surface comprising a front face and an opposing back face each extending between a top face and an opposing bottom face and also between a first side face and an opposing second side face, the second housing having a long axis extending between the first side face and the second side face, the interior surface bounding a chamber that is adapted to receive a ballast, the chamber being bounded by the front face, the opposing back face, the to face, the opposing bottom face, the first side face and the opposing second side face;

a second projection outwardly extending from the top face of the second housing, the second projection bounding a port extending therethrough that communicates with the chamber;

a second recess formed on the bottom face and projecting into the chamber; and an elongated second locking groove recessed on the second side face and orientated so as to at least partially extend between the top face and the opposing bottom face, the second locking groove including an elongated channel and a constricted mouth through which the channel can be accessed, the first side face of the first barrier being disposed adjacent to and opposingly facing the second side face of the second barrier so that the first barrier and the second barrier are longitudinally aligned end-to-end and so that the first locking groove of the first barrier is opposingly facing and is aligned with the second locking groove of the second barrier; and an elongated first locking shaft being slidably received within the first locking groove and the second locking groove so as to secure the first barrier to the second barrier.

16. A barrier system comprising:

a first barrier comprising:

an elongated first housing having an exterior surface and an interior surface, the exterior surface comprising a front face and an opposing back face each extending between a top face and an opposing bottom face and also between a first side face and an opposing second side face, the first housing having a long axis extending between the first side face and the second side face, the interior surface bounding a chamber that is adapted to receive a ballast, the chamber being bounded by the front face, the opposing back face, the top face, the opposing bottom face, the first side face and the opposing second side face;

an elongated first locking groove recessed on the first side face and orientated so as to at least partially extend between the top face and the opposing bottom face, the first locking groove including an elongated channel and a constricted mouth through which the channel can be accessed; and a first projection outwardly extending from the to face of the first housing, the first projection bounding a port extending therethrough that communicates with the chamber;

a second barrier comprising:

an elongated second housing having an exterior surface and an interior surface, the exterior surface comprising a front face and an opposing back face each extending between a top face and an opposing bottom face and also between a first side face and an opposing second side face, the second housing having a long axis extending between the first side face and the second side face, the interior surface bounding a chamber that is adapted to receive a ballast, the chamber being bounded by the front face, the opposing back face, the to face, the opposing bottom face, the first side face and the opposing second side face;

an elongated second locking groove recessed on the second side face and orientated so as to at least partially extend between the top face and the opposing bottom face, the second locking groove including an elongated channel and a constricted mouth through which the channel can be accessed, the first side face of the first housing being disposed adjacent to and opposingly facing the second side face of the second housing so that the first housing and the second housing are longitudinally aligned end-to-end and so that the first locking groove of the first barrier is opposingly facing and is aligned with the second locking groove of the second barrier; and a second projection outwardly extending from the to face of the second housing, the second projection bounding a port extending therethrough that communicates with the chamber; and an elongated first locking shaft being slidably received within the first locking groove and the second locking groove so as to secure the first barrier to the second barrier.

17. The barrier system as recited in claim 16, wherein the first barrier further comprises:

first projection outwardly extending from the top surface of the first housing, the first projection bounding an open port extending therethrough that communicates with the chamber; and a first recess formed on the bottom surface of the first housing and projecting into the chamber, the first recess having a configuration complementary to the first projection.

* * * * *